US006733881B2

(12) United States Patent
Kasabo et al.

(10) Patent No.: US 6,733,881 B2
(45) Date of Patent: May 11, 2004

(54) ACRYLIC FIBER AND A MANUFACTURING PROCESS THEREFOR

(75) Inventors: Yukio Kasabo, Hiroshima (JP); Katsuhiko Ikeda, Hiroshima (JP); Yasuyuki Fujii, Hiroshima (JP); Yoshihiko Mishina, Osaka (JP); Ryo Ochi, Hiroshima (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 0 days.

(21) Appl. No.: 10/429,821

(22) Filed: May 6, 2003

(65) Prior Publication Data

US 2003/0207109 A1 Nov. 6, 2003

Related U.S. Application Data

(62) Division of application No. 10/019,026, filed as application No. PCT/JP00/04127 on Jun. 23, 2000, now Pat. No. 6,610,403.

(30) Foreign Application Priority Data

| | | |
|---|---|---|
| Jun. 25, 1999 | (JP) | 11-180275 |
| Aug. 12, 1999 | (JP) | 11-228496 |
| Mar. 1, 2000 | (JP) | 2000-056202 |

(51) Int. Cl.[7] ..... D01F 6/00

(52) U.S. Cl. ..... 428/364; 428/394; 428/397; 428/400

(58) Field of Search ..... 428/364, 394, 428/397, 400

(56) References Cited

U.S. PATENT DOCUMENTS

| | | | |
|---|---|---|---|
| 3,621,087 | A | 11/1971 | Shimamura et al. |
| 4,812,361 | A | 3/1989 | Takemoto et al. |
| 5,286,844 | A | 2/1994 | Nishida et al. |
| 6,245,423 | B1 | 6/2001 | Ikeda et al. |

FOREIGN PATENT DOCUMENTS

| | | |
|---|---|---|
| JP | 61-138710 | 6/1986 |
| JP | 3-227405 | 10/1991 |
| JP | 5-148709 | 6/1993 |

*Primary Examiner*—N. Edwards
(74) *Attorney, Agent, or Firm*—Oblon, Spivak, McClelland, Maier & Neustadt, P.C.

(57) ABSTRACT

There is disclosed an acrylic fiber (a) consisting of an acrylonitrile polymer comprising an acrylonitrile unit in at least 80 wt % and less than 95 wt %, (b) having a monofilament dry strength of 2.5 to 4.0 cN/dtex, (c) having a monofilament dry elongation of 35 to 50%, and (d) forming a crack with a length of 20 $\mu$m or more in its tension rupture lateral surface along the filament axis direction when rupturing the monofilament in a tension test. The fiber has even orientation in its surface and inside; is significantly improved in dry strength, dry elongation and dyeability; and exhibits wool-like hand feeling. It is, therefore, quite suitable as a synthetic fiber for various applications such as a garment material, e.g., a sweater and a home furnishing material such as a pile.

6 Claims, 11 Drawing Sheets

(a)

(b)

(a)

(b)

(a)

(b)

(a)

(b)

(a)

(b)

(a)

(b)

ACRYLIC FIBER AND A MANUFACTURING PROCESS THEREFOR

This application is a Division of application Ser. No. 10/019,026 flied on Dec. 26, 2001 now U.S. Pat. No. 6,610,403, pending, which is the National Stage of PCT/JP00/04127, filed Jun. 23, 2000.

TECHNICAL FIELD

This invention relates to an acrylic fiber generally suitable to applications such as a garment and a home furnishing especially pile fabrics.

BACKGROUND ART

An acrylic fiber suitable to garments is required to have a good balance between its strength, elongation and dyeability.

An acrylic fiber is generally prepared by wet spinning. It has been a conventional practice to increase a ratio of (a drawing rate of a coagulated filament)/(a discharge linear velocity of a spinning feed solution from a spinneret capillary) in a coagulation bath and to increase a draw ratio in a subsequent step for achieving a high-strength fiber with high orientation.

However, increasing a ratio of (a drawing rate of a coagulated filament)/(a discharge linear velocity of a spinning feed solution from a spinneret capillary) in a coagulation bath, i.e., increasing a drawing rate of a coagulated filament, means a shorter coagulation time for a spinning feed solution in the coagulation bath. Coagulation and stretching, therefore, simultaneously occur in the coagulation bath, resulting in formation of a skin layer in a coagulated filament, which leads to inadequate solvent displacement inside the fiber.

Thus, the surface of the fiber has a higher fibrillated and highly oriented structure, while its inside has a coarse structure without fibrillation. When stretched with a high stretching ratio, a product becomes a fiber with a poor elongation, which will give a cloth with a stiff hand feeling. A fiber with an uneven orientation between its surface and inside provides a poorly elastic staple fiber, which will give a cloth with an inadequate repulsion.

A fiber with an excessively oriented surface has a drawback of a deteriorated dyeability because the highly oriented surface inhibits diffusion of a dye during a dyeing process.

JP-A 61-199707 has described a spinning process using a coagulation bath with a sufficiently higher concentration within a concentration range that a skin layer does not form. However, when using an aqueous solution of an organic solvent as a coagulation bath, a concentration range of the organic solvent that a skin layer does not form is quite higher, so that a coagulation rate becomes too late to increase a drawing rate of the coagulated filament, leading not only to an extremely lower yield but also to problems such as irregularities and fusion between fibers.

In home furnishing applications, particularly for a high-pile or boa, a cross section of a fiber is changed for providing hand feeling closer to animal hair. In these applications, good brushing effect, higher flexibility, softness, etc. are required. Brushing effect is more improved as a friction on a fiber surface is lower. It is thus believed that a dull material in which an additive such as titanium dioxide is used for emphasizing brightness generally exhibits an improved brushing effect. In the technique, color-developing properties of an acrylic fiber are, however, hampered by the additive.

JP-A 11-21769 has disclosed a technique that apparent luster and fiber color-developing are chosen as appropriate and an organopolysiloxane is bound to give slimy and smooth touch like an animal hair to the fiber surface. In the technique, while slimy and smooth touch is emphasized, the fiber may have poor softness and color-developing properties. It is necessary for an acrylic fiber with reduced luster, good color-developing properties and good brushing effect that its surface is not smoothed but a contact area between fibers is reduced when it is processed to be a pile or boa cloth, by deliberately corrugating the fiber surface. For hand feeling, a fiber well-balanced in its strength and elongation is required. In the light of these conditions, JP-A 64-33210 has disclosed a process for preparing a dry acrylic fiber with more natural luster by corrugating a fiber surface. In the process, a spinneret, however, has an orifice hole of special shape to corrugate the surface. Thus, the fiber surface corrugation is considerably limited.

Flexibility and softness in a boa or high pile may be achieved by combining several types of fibers with different cross sections. It is believed that typically a flat or Y-shaped cross section of an acrylic fiber is effective for achieving the above properties. In particular, an acrylic fiber with a Y-shaped cross section gives soft hand feeling because its tip is split while having good flexibility because it retains a Y-shaped cross section in its root.

In the acrylic fiber disclosed in JP-A 10-251915, a monofilament 20 has a substantially Y-shaped cross section where three radially extending rectangular arms 21 are jointed with a jointing angle of 120° as shown in FIG. 7. In the joint of these arms 21, openings K1 or holes K2 are formed for adjusting the joint length c to be 30 to 95% of its width d. It allows the filament to be easily split along a longitudinal direction to realize soft hand feeling. In the acrylic fiber disclosed in the patent application, a filament may be split before polisher processing a boa or high pile due to the openings K1 or the holes K2 formed in the joint. Thus, it may result in, for example, generating fluffs during spinning. Furthermore, the fiber may not be easily dried due to water trapped in the openings K1 or the holes K2, leading to a longer drying step during spinning the fiber and thus to a reduced productivity.

DISCLOSURE OF THE INVENTION

An objective of this invention is to provide, for a garment material, an acrylic fiber which has even orientation in its surface and inside, gives a staple fiber with adequate elasticity to provide a cloth with a repulsion; and to provide the fiber which exhibits good physical properties such as a strength, an elongation and dyeability and exhibits softness by modifying its surface shape.

Another objective of this invention is to provide, for a home furnishing material, an acrylic synthetic fiber which has good color-developing properties with reduced luster and good brushing effect, and an acrylic synthetic fiber which retains the status where a plurality of flat arms radially extending from a center along a longitudinal direction are jointed together and the fiber tip can be readily split by applying a mechanical force during processing into a fluffy product.

Another objective of this invention is to provide a process for easily and satisfactorily manufacturing an acrylic fiber which has even orientation in its surface and inside and exhibits good properties such as a strength, an elongation and dyeability, by, during preparing a coagulated filament, controlling the thickness of a skin layer of the coagulated filament to provide a fiber evenly coagulated to its inside, i.e., by preventing a solvent inside the fiber from being inadequately diffused and thus preventing the solvent from being quickly diffused during washing.

The first aspect of this invention is directed to an acrylic fiber (a) consisting of an acrylonitrile polymer comprising an acrylonitrile unit in at least 80 wt % and less than 95 wt %, (b) having a monofilament dry strength of 2.5 to 4.0 cN/dtex, (c) having a monofilament dry elongation of 35 to 50%, and (d) forming a crack with a length of 20 $\mu$m or more in its tension rupture lateral surface along the filament axis direction when rupturing the monofilament in a tension test.

The second aspect of this invention is directed to an acrylic fiber (a) comprising corrugations on its surface, (b) having an average tilt angle of 15 to 20° between two adjacent corrugations in a cross section vertical to the fiber axis direction, (c) having a maximum level difference of 0.15 to 0.35 $\mu$m between the bottom and the top of the corrugations, and (d) exhibiting a lusteriness of 10 to 20% in a lusteriness determination method for a 45° mirror surface for a fiber bundle surface.

In one embodiment of the second aspect of this invention, the acrylic fiber (e) consists of an acrylonitrile polymer comprising an acrylonitrile unit in at least 80 wt % and less than 95 wt %, (f) has a monofilament dry strength of 2.0 to 4.0 cN/dtex, (g) has a monofilament dry elongation of 15 to 40%, and (h) forms a crack with a length of 20 $\mu$m or more in its tension rupture lateral surface along the filament axis direction when rupturing the monofilament in a tension test.

The third aspect of this invention is directed to an acrylic fiber (a) comprising a plurality of flat arms radially extending from a center along a longitudinal direction and (b) forming a crack with a length of 200 $\mu$m or more in the center of its tension rupture lateral surface along the filament axis direction when rupturing the monofilament in a tension test.

In one embodiment of the third aspect of this invention, the acrylic fiber (c) consists of an acrylonitrile polymer comprising an acrylonitrile unit in at least 80 wt % and less than 95 wt %, (d) has a monofilament dry strength of 2.0 to 4.0 cN/dtex, and (e) has a monofilament dry elongation of 15 to 40%.

This invention further provides a process for manufacturing an acrylic fiber comprising the steps of: discharging a spinning feed solution comprising an acrylonitrile polymer comprising 80 wt % or more and less than 95 wt % of acrylonitrile unit in an organic solvent, into the first coagulation bath consisting of an aqueous organic solvent solution at 30 to 50° C. containing 20 to 70 wt % of an organic solvent which may be the same as or different from the organic solvent for the spinning feed solution, to form a coagulated filament; drawing the filament from the first coagulation bath at a rate of 0.3 to 2.0 times of the discharge linear velocity of the spinning feed solution; stretching the filament by 1.1 to 2.0 times in the second coagulation bath consisting of an aqueous organic solvent solution at 30 to 50° C. containing 20 to 70 wt % of an organic solvent which may be the same as or different from any of the two organic solvents; and subsequently conducting wet heat stretching of the filament by three times or more.

In one embodiment of the above manufacturing process, there is provided a process where the concentration of the organic solvent in the first coagulation bath is 40 to 70 wt %; the drawing rate of a coagulated filament from the first coagulation bath is 0.3 to 0.6 times of the discharge linear velocity of the spinning feed solution; and the concentration of the organic solvent in the second coagulation bath is 40 to 70 wt %.

In another embodiment of the above manufacturing process, there is provided a process where the concentration of the organic solvent in the first coagulation bath is 20 to 60 wt %; the drawing rate of a coagulated filament from the first coagulation bath is 0.6 to 2.0 times of the discharge linear velocity of the spinning feed solution; and the concentration of the organic solvent in the second coagulation bath is 20 to 60 wt %.

It is preferable in the manufacturing processes of this invention that the organic solvents in the spinning feed solution, the first coagulation bath and the second coagulation bath are dimethylacetamide and the first and the second coagulation bathes are at the same temperature and have the same composition.

$$Y=-X+105 \quad \text{(Eq.1)}$$

$$Y=-(1/2)X+77.5 \quad \text{(Eq.2)}$$

$$Y=-4X+315 \quad \text{(Eq.3)}$$

wherein Y is a coagulation-bath temperature (° C.) and X is a concentration of an organic solvent (wt %).

Figure 2:
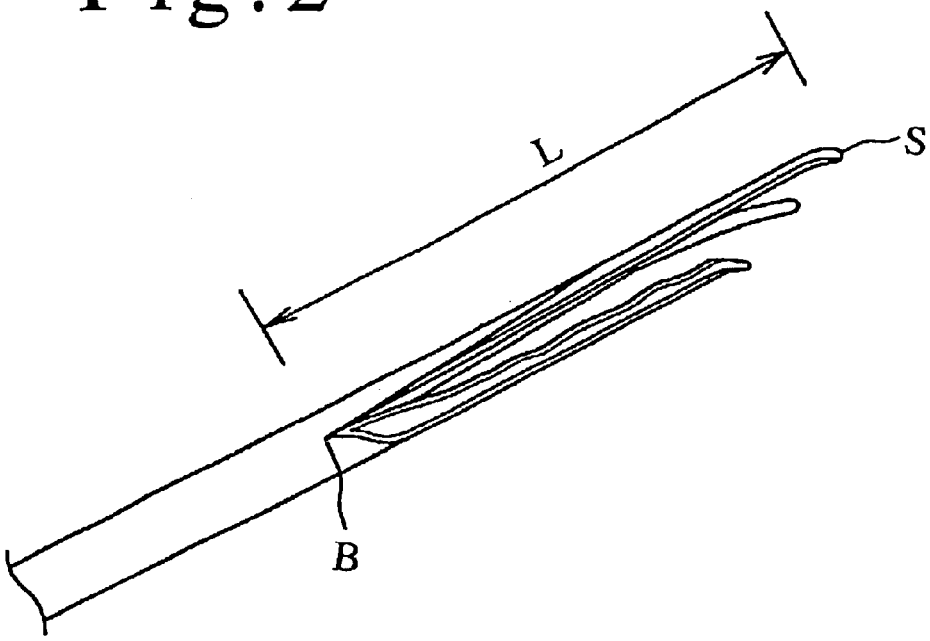

FIG. 2 schematically shows the status of a crack part formed in a tension rupture lateral surface of a monofilament in a tension test as observed by scanning electron microscopy, in which the crack is relatively long.

Figure 3:
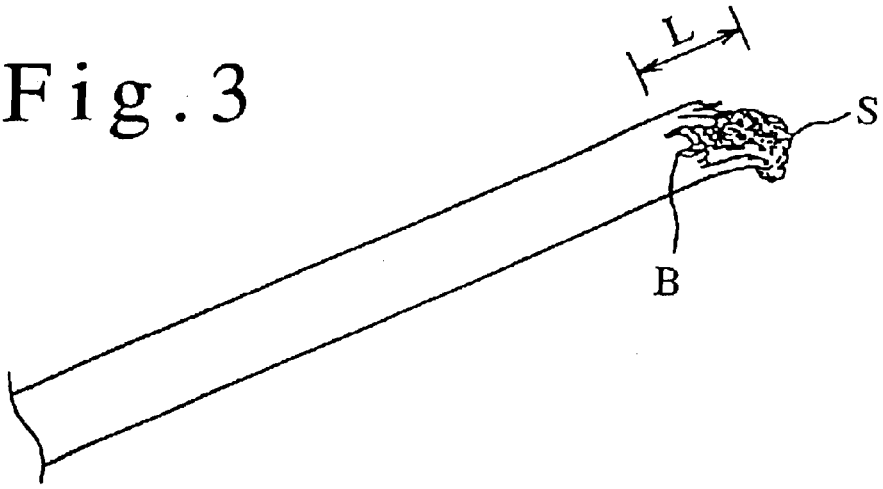

FIG. 3 schematically shows the status of a crack part formed in a tension rupture lateral surface of a monofilament in a tension test as observed by scanning electron microscopy, in which the crack is relatively short.

Figure 4:
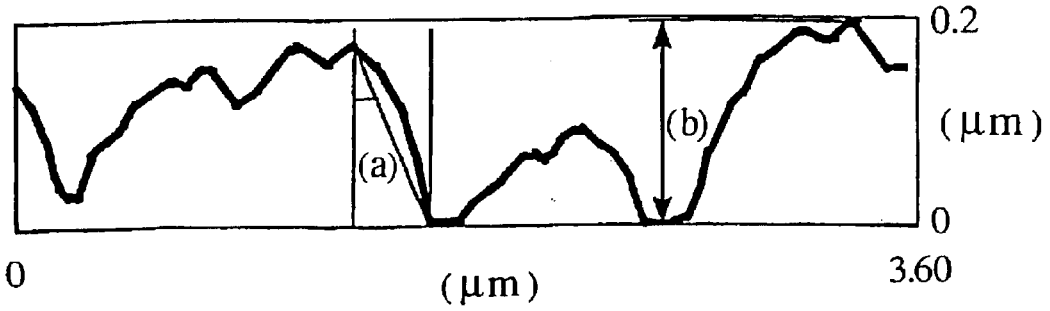

FIG. 4 is a conceptual diagram illustrating a part of a fiber surface shape, where (a) is a tilt angle (an average tilt angle is determined by measuring a tilt angle for each corrugation and then averaging them) and (b) is a level difference (a maximum level difference is the difference between the higher and the lower parts).

Figure 5A:
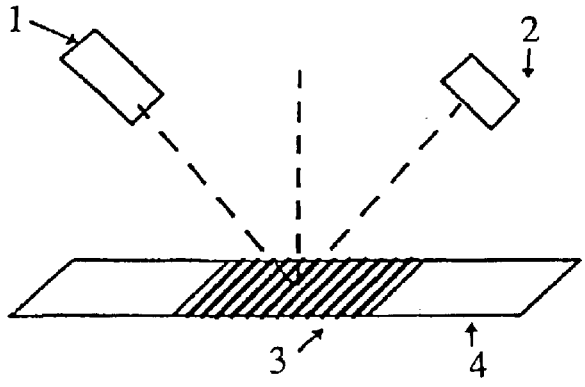
Figure 5B:
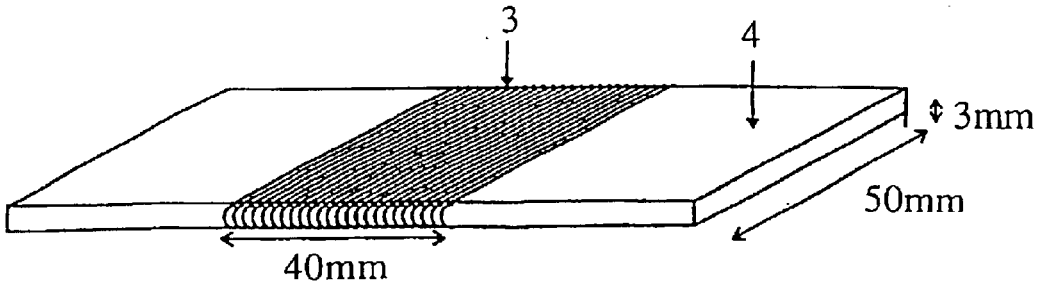

FIG. 5(*a*) is a conceptual diagram for determination of a luster, and FIG. 5(*b*) shows a sample model when determining a luster.

Figure 6:
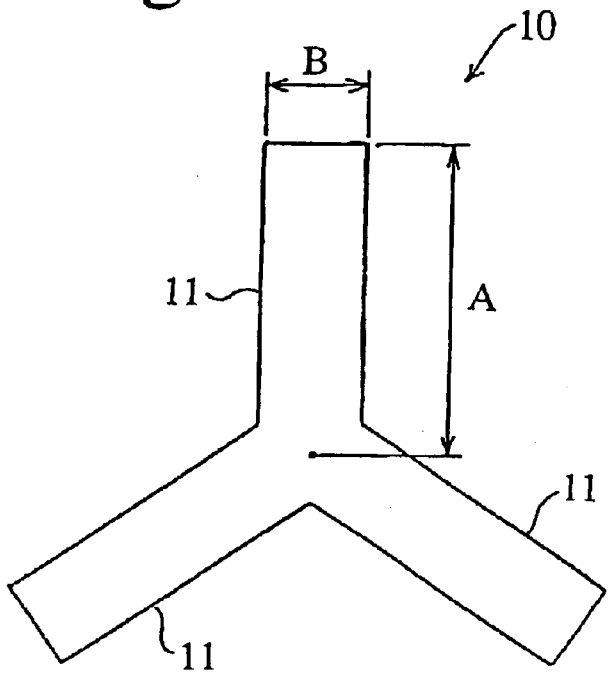

FIG. 6 is a front view illustrating an example of the shape of a spinneret capillary in a spinneret used in a process for manufacturing an acrylic fiber according to this invention.

Figure 7:
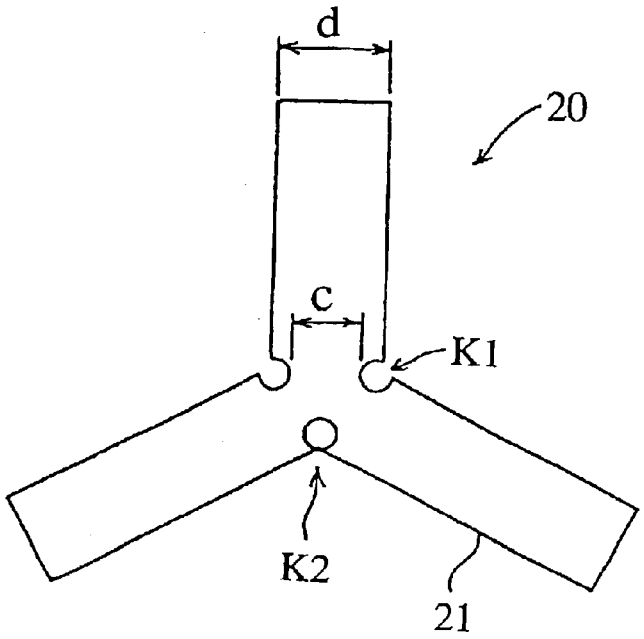

FIG. 7 schematically shows a cross section of a conventional acrylic fiber.

Figure 8:
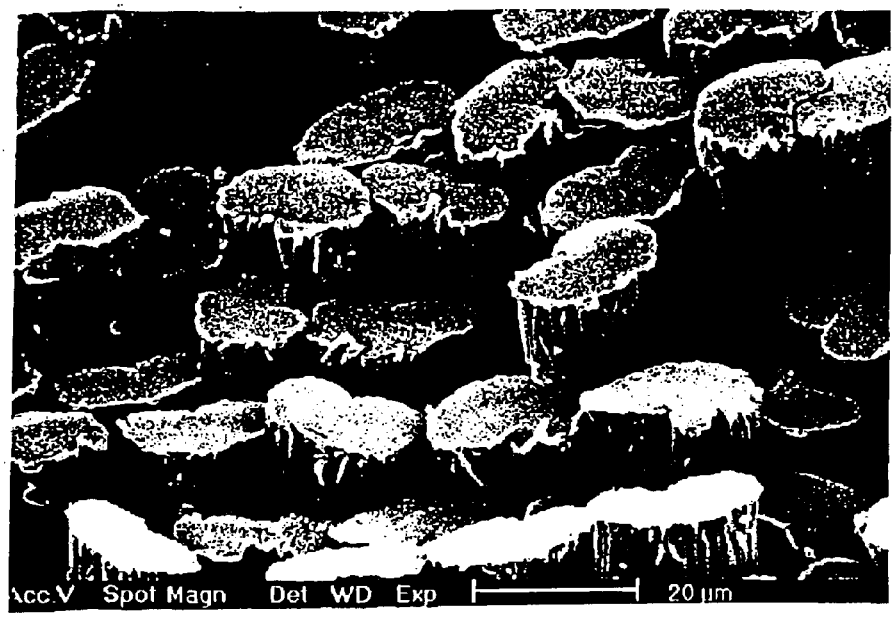
Figure 8:
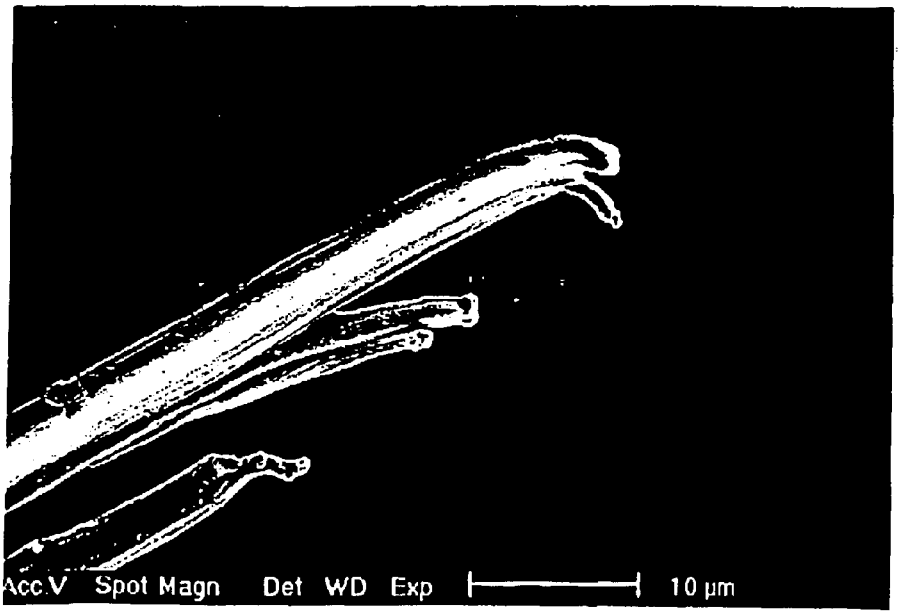

FIG. 8(*a*) is a scanning electron microscope (SEM) photograph which shows oblique view of the fiber obtained in example 1. FIG. 8(*b*) is a SEM photograph which shows a lateral surface of the fiber obtained in example 1 which was ruptured in the tension test.

Figure 9:
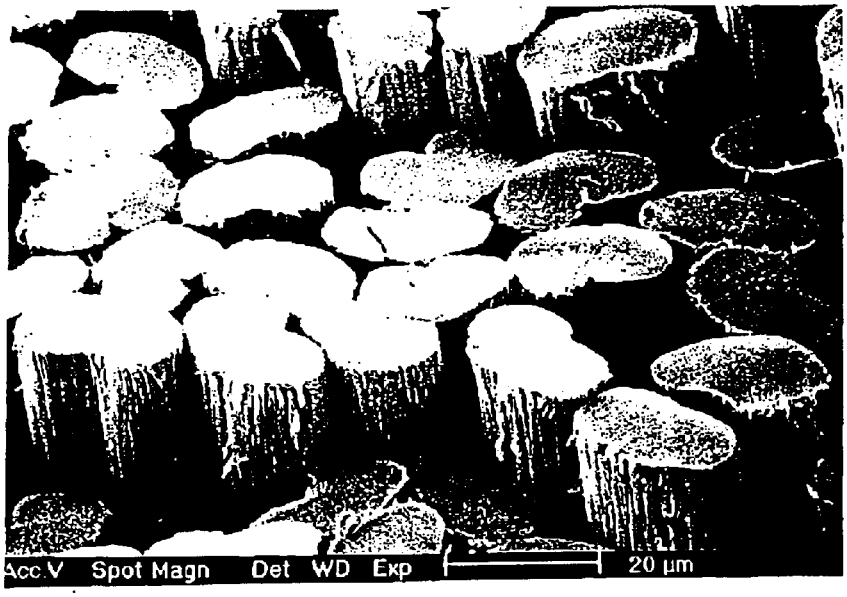
Figure 9:
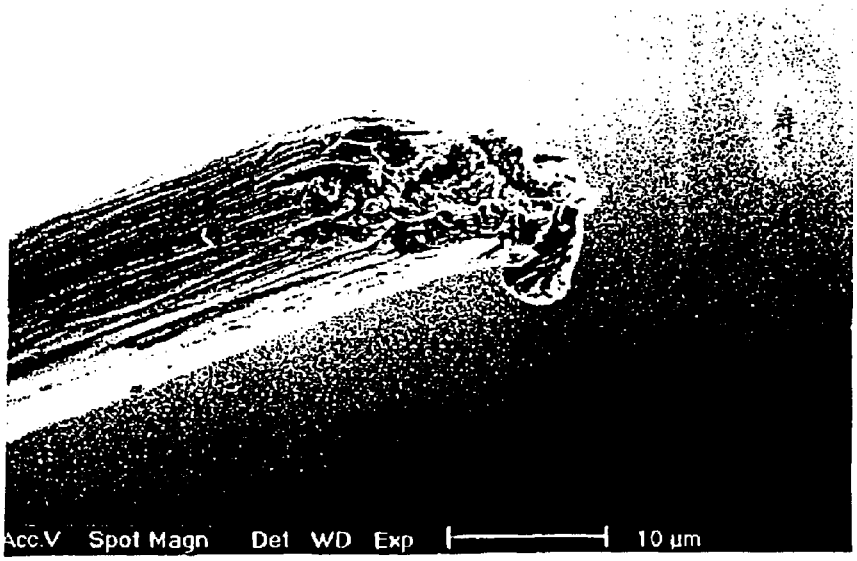

FIG. 9(*a*) is a SEM photograph which shows oblique view of the fiber obtained in comparative example 1. FIG. 9(*b*) is a SEM photograph which shows a lateral surface of the fiber obtained in comparative example 1 which was ruptured in the tension test.

Figure 10:
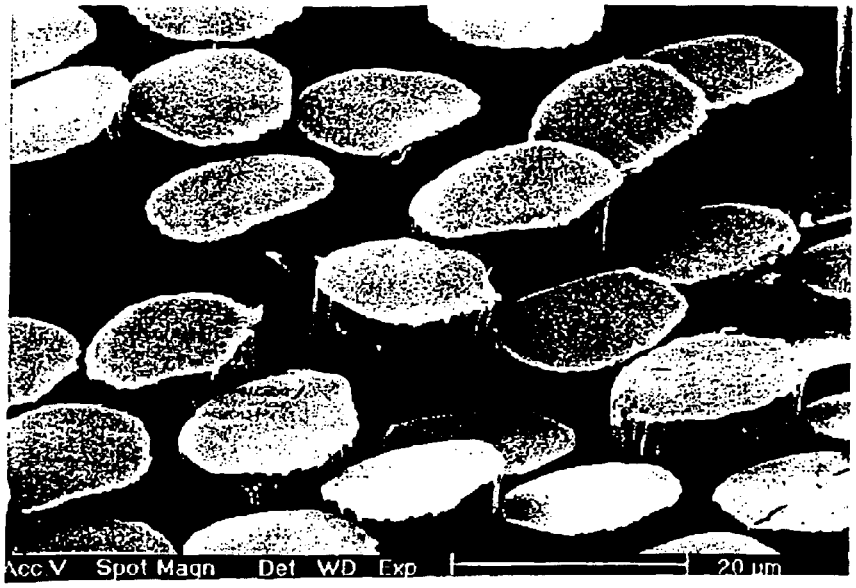

FIG. 10 is a SEM photograph which shows oblique view of the fiber obtained in example 3.

Figure 11:
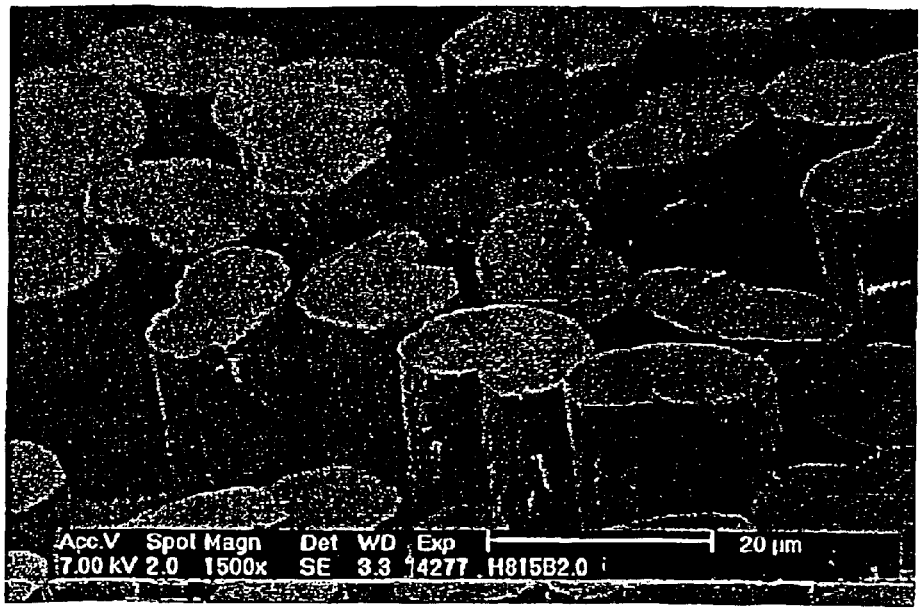

FIG. 11 is a SEM photograph which shows oblique view of the fiber obtained in comparative example 5.

Figure 12:
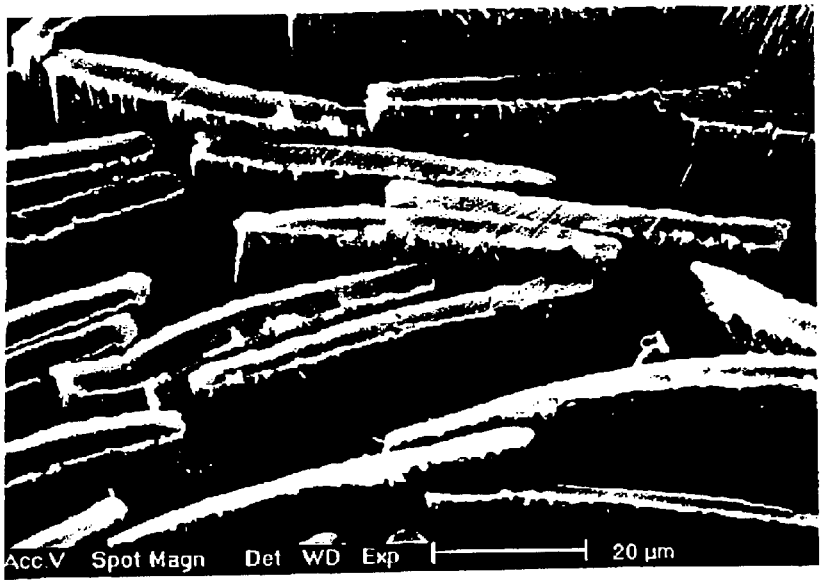
Figure 12:
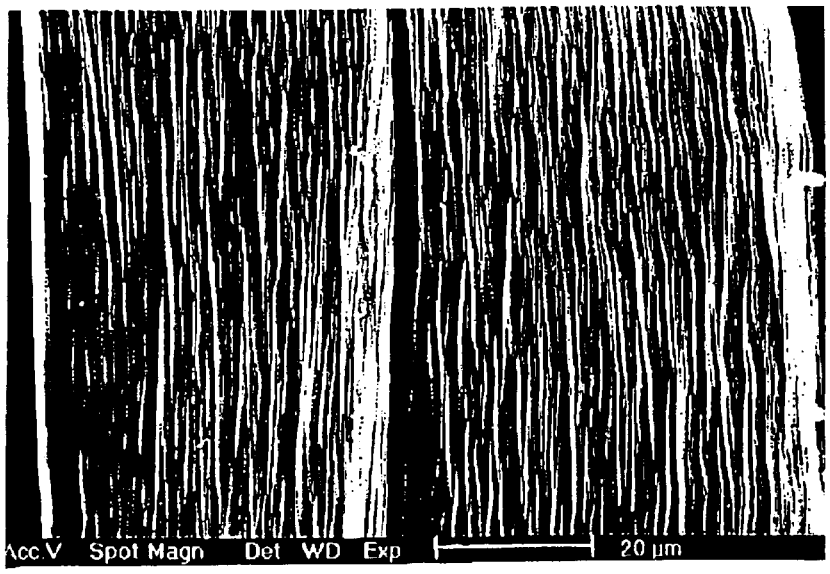

FIG. 12(*a*) is a SEM photograph which shows oblique view of the fiber obtained in example 7. FIG. 12(*b*) is a SEM photograph which shows the surface of the fiber obtained in example 7.

Figure 13:
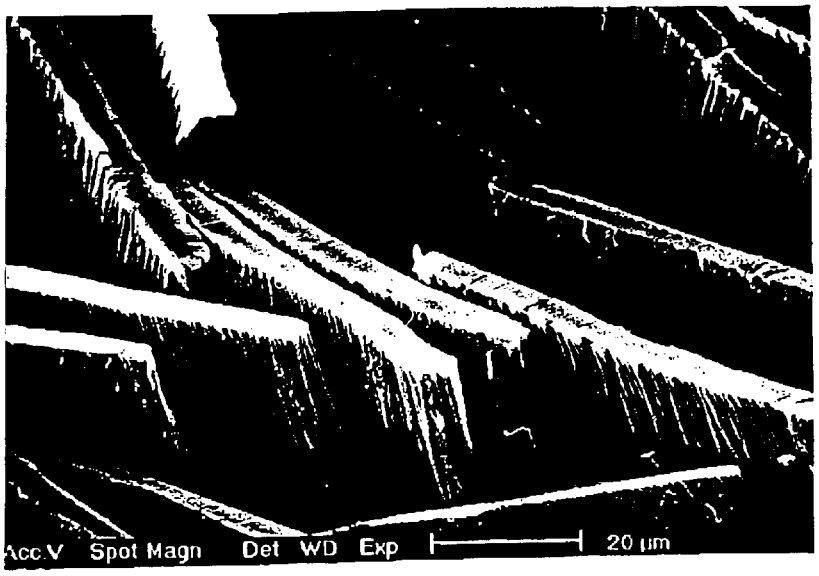
Figure 13:
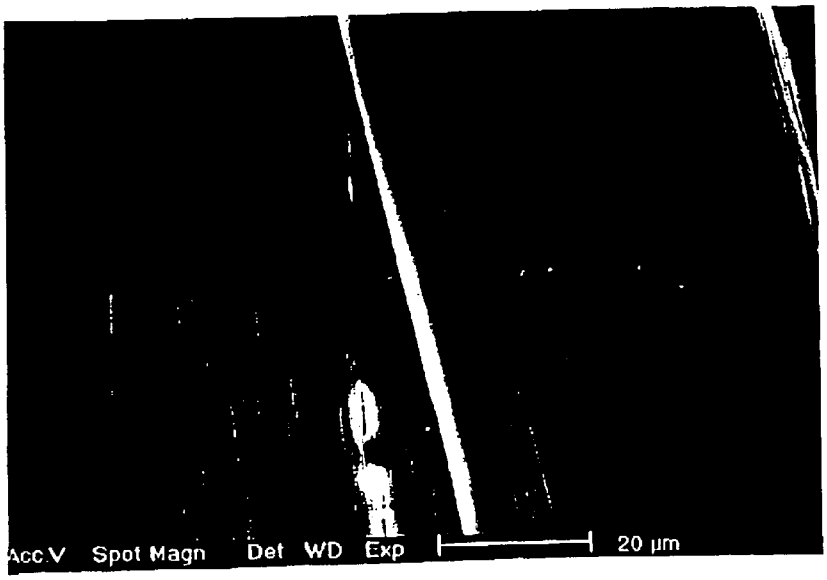

FIG. 13(*a*) is a SEM photograph which shows oblique view of the fiber obtained in comparative example 6. FIG. 13(*b*) is a SEM photograph which shows the surface of the fiber obtained in comparative example 6.

Figure 14:
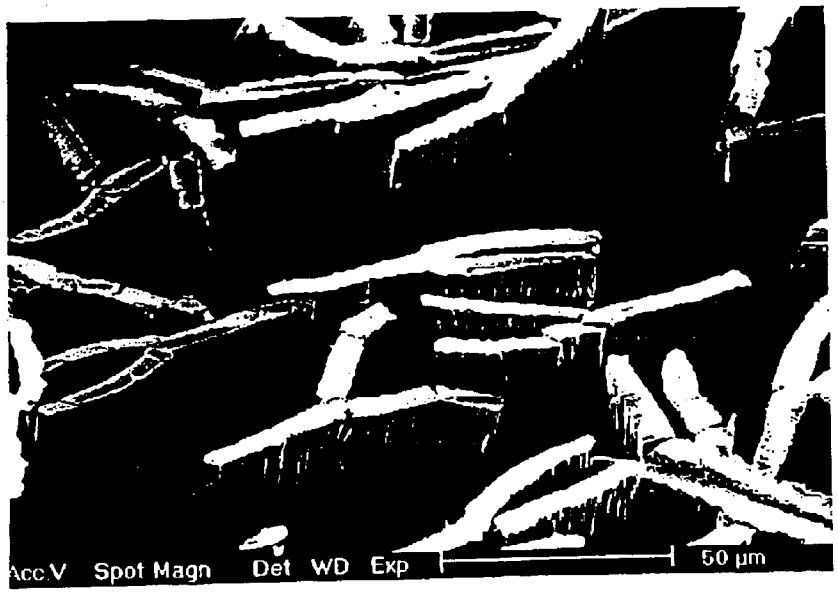
Figure 14:
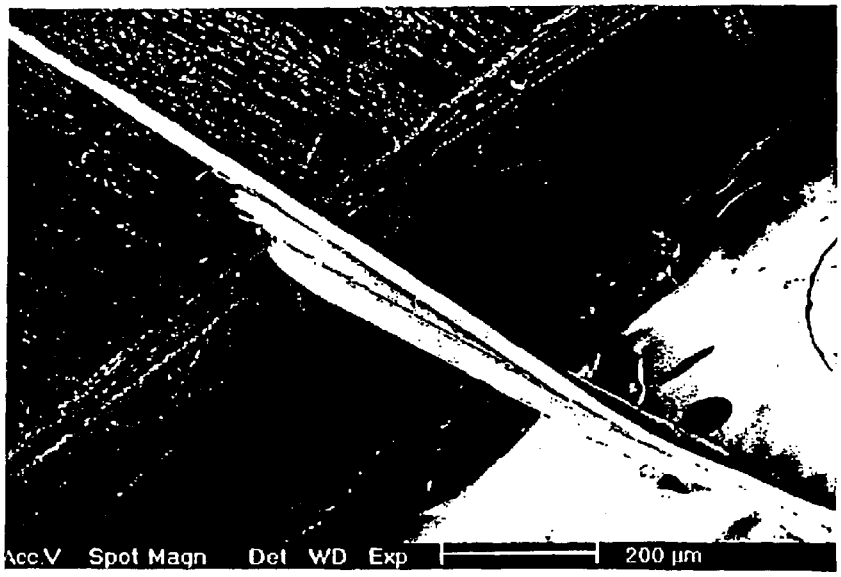

FIG. 14(*a*) is a SEM photograph which shows oblique view of the fiber obtained in example 9. FIG. 14(*b*) is a SEM photograph which shows a lateral surface of the fiber obtained in example 9 which was ruptured in the tension test.

Figure 15:
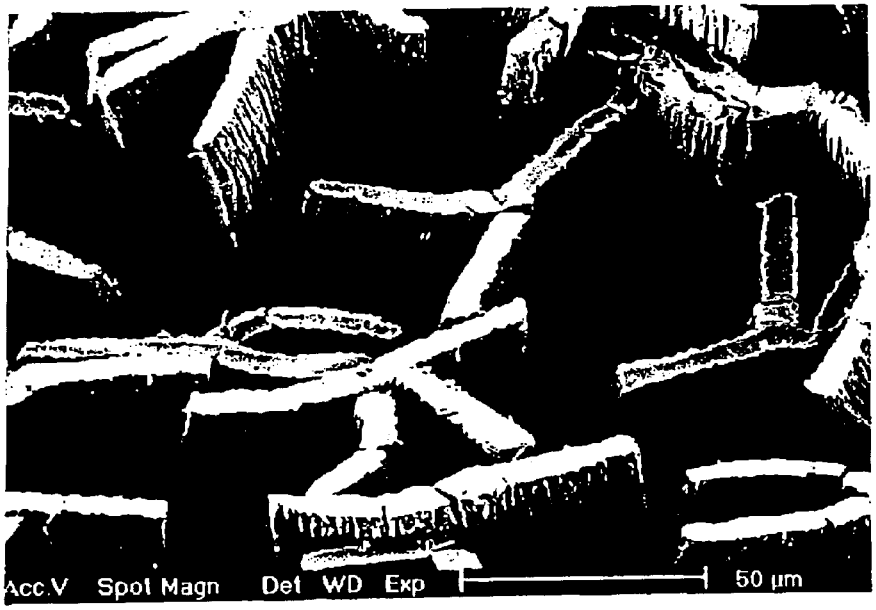
Figure 15:
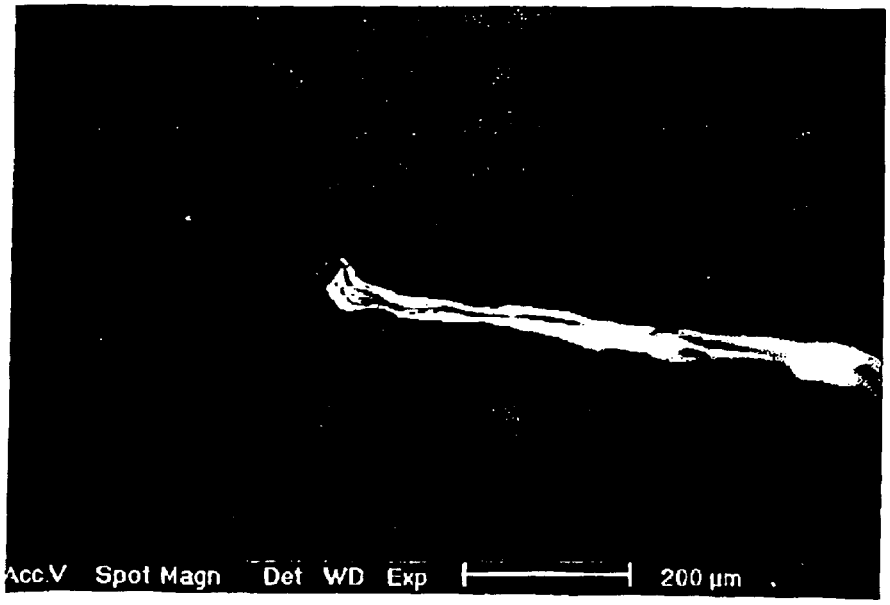

FIG. 15(*a*) is a SEM photograph which shows oblique view of the fiber obtained in comparative example 11. FIG. 15(*b*) is a SEM photograph which shows a lateral surface of the fiber obtained in comparative example 11 which was ruptured in the tension test.

BEST MODE FOR CARRYING THE INVENTION

An acrylic fiber of this invention is suitable mainly to a garment such as a sweater and a home furnishing application such as a pile. In the light of solubility of a polymer and stability of a spinning feed solution during fibrillation by wet spinning, it is preferable to use a copolymer with a relatively small amount of acrylonitrile unit, i.e., less than 95 wt % of acrylonitrile, as a fiber material. If the amount of acrylonitrile unit is too low in the acrylonitrile polymer used as a fiber material, there may be inadequate wool-like hand feeling required for an acrylic fiber for an application such as sweater and a pile product. The concentration is, therefore, preferably at least 80 wt %.

The material may be a mixture of acrylonitrile polymers containing at least 80 wt % and less than 95 wt % of acrylonitrile.

An acrylonitrile polymer is a copolymer of acrylonitrile with a monomer polymerizable with acrylonitrile. Monomers which may be used as a copolymer component include, but not limited to, (meth)acrylates such as methyl (meth) acrylate, ethyl (meth)acrylate, propyl (meth)acrylate, butyl (meth)acrylate and hexyl (meth)acrylate; vinyl halides such as vinyl chloride, vinyl bromide and vinylidene chloride; acids having a polymerizable double bond and their salts such as (meth)acrylic acid, itaconic acid and crotonic acid; maleimide; phenylmaleimide; (meth)acrylamide; styrene; α-methylstyrene; vinyl acetate; sulfone-containing polymerizable unsaturated monomers such as sodium styrenesulfonate, sodium allylsulfonate, β-sodium styrenesulfonate, sodium methallylsulfonate; and pyridine-containing polymerizable unsaturated monomers such as 2-vinylpyridine and 2-methyl-5-vinylpyridine.

An acrylonitrile polymer as a fiber material may be readily prepared by, for example, redox polymerization using an aqueous solution, suspension polymerization in a heterogeneous system, emulsion polymerization using a dispersing agent or any other polymerization method.

An acrylic fiber in the first embodiment of this invention has a monofilament dry strength of 2.5 to 4.0 cN/dtex, has a monofilament dry elongation of 35 to 50%, and forms a crack with a length of 20 μm or more in its tension rupture lateral surface along the filament axis direction when rupturing the monofilament in a tension test.

If the monofilament dry strength is lower than 2.5 cN/dtex or the dry elongation is more than 50% in the acrylic fiber, there may be generated many fluffs due to filament breaking during spinning, leading to a deteriorated process passage and significant deterioration in spinnability.

If the monofilament dry strength is higher than 4.0 cN/dtex or the dry elongation is less than 35%, there may often be inadequate wool-like hand feeling required for an acrylic fiber for an application such as a garment, e.g., a sweater and a home furnishing, e.g., a pile.

The length of the crack formed along a fiber axis in a tension test is an index indicating difference in orientation between the surface and the inside of the fiber. The feature of a crack with a length of 20 μm or more in the tension rupture lateral surface of the monofilament along the filament axis direction in the acrylic fiber of this invention indicates a structure in which orientation is even not only in its surface layer but also in its inside.

FIG. 2 shows a ruptured acrylic fiber in which orientation is even not only in its surface layer but also in its inside, in a tension test. The acrylic fiber evenly oriented to its inside, i.e., orientation is even both in its surface and its inside, is ruptured in a tension rupture test such that there are a plurality of rupture points in a tension rupture section. There are, therefore, formed a long crack in the tension rupture lateral surface along the fiber axis direction. It is predicted that the fiber has a structure evenly oriented not only in its surface layer but also in its inside if the length L from the bottom B to the top S of the crack is 20 μm or more as shown in FIG. 2.

On the other hand, FIG. 3 shows a ruptured acrylic fiber in which its surface is oriented while its inside is of a coarse structure, in a tension test. Such a fiber is ruptured in a tension rupture test such that there is one rupture point in a tension rupture section. There is not, therefore, formed a crack in the tension rupture lateral surface of the monofilament along the fiber axis direction, or if any, it is quite short. The length L from the bottom B to the top S of the crack is less than 20 μm as shown in FIG. 3. A staple fiber made of the fiber has an inadequate elasticity. As a result, a cloth after processing does not have an adequate repulsion and thus does not exhibit satisfactory hand feeling required for a cloth utilized in an application such as a garment, e.g., a sweater and a home furnishing, e,g., a pile.

A status of the tension rupture lateral surface of a monofilament is observed for a rupture surface formed after rupturing the monofilament at a deformation rate of 100%/min under the conditions of 23° C. and 50% RH.

In an acrylic fiber according to the first aspect of this invention, a fiber cross section is preferably a perfect or essentially perfect circle in the light of spinnability, color-developing properties. and wool-like elasticity. Specifically, a ratio of long/short axes in the fiber cross section is preferably 1.0 to 2.0, more preferably 1.0 to 1.2 which means a more perfect circle. A fiber having such a cross section is suitable to a garment such as a sweater.

Next, there will be described an acrylic fiber according to the second aspect of this invention.

The acrylic fiber of the second aspect of this invention has fine corrugations on its surface which may be observed as creases. In the crease-like corrugations, an average tilt angle between adjacent corrugations (hereinafter, referred to as an "average tilt angle") is 15 to 20° in a cross section perpendicular to the fiber axis direction and a maximum level difference between the bottom and the top of the corrugations (a maximum level difference between the bottom and the top of the creases; hereinafter, referred to as a "maximum level difference") is 0.15 to 0.35 μm.

When an acrylic fiber meets the conditions of an average tilt angle of 15 to 20° and a maximum level difference of 0.15 to 0.35 μm, a contact area between fibers is reduced, brushing effect is improved, softness is provided after processing into a pile or boa, and the surface corrugations control luster in the fiber. If the average tilt angle is less than 15°, the number of corrugations or the creases is increased, and may lead to increase in a contact area between fibers and thus to deteriorated brushing effect. If the average tilt angle is higher than 25°, the corrugations or the creases are reduced, so that a contact area between fibers is increased.

If the maximum level difference is less than 0.15 μm, brushing effect (i.e. hair handle property) tends to be poor and slimy and smooth touch which adversely affects hand feeling may be caused. On the other hand, if more than 0.35 μm, the fiber may be readily split, leading to problems in processability such as spinnability.

An acrylic fiber according to the second aspect of this invention exhibits (d) a luster of 10 to 20% in a luster determination method for a 45° mirror surface for a fiber bundle surface. Tone after processing into a pile or boa may be less deep when a luster is too high, while color developing is reduced when a luster is too low. Thus, the above range is preferable.

Preferably, the acrylic fiber according to the second aspect of this invention further (e) consists of an acrylonitrile polymer comprising an acrylonitrile unit in at least 80 wt % and less than 95 wt %, (f) has a monofilament dry strength of 2.0 to 4.0 cN/dtex, (g) has a monofilament dry elongation of 15 to 40%, and (h) may form a crack with a length of 20 μm or more in its tension rupture lateral surface along the filament axis direction when rupturing the monofilament in a tension test.

In the second aspect of this invention, if the monofilament dry strength of the acrylic fiber is less than 2.0 cN/dtex or its dry elongation is more than 40%, there may be generated many fluffs due to filament breaking during spinning, leading to a deteriorated process passage and poor hand feeling due to elongation of the fiber during boa or high-pile processing.

If the monofilament dry strength is higher than 4.0 cN/dtex or the dry elongation is less than 15%, there may often be inadequate wool-like hand feeling required for an acrylic fiber for an application such as a garment, e.g., a sweater and a home furnishing, e.g., a pile.

As mentioned above, the feature of a crack with a length of 20 μm or more in the tension rupture lateral surface of the monofilament along the filament axis direction indicates a structure in which orientation is even not only in its surface layer but also in its inside. Therefore, after processing, it provides a cloth with an adequate repulsion meeting hand feeling required for a cloth for a garment such as a sweater and a home furnishing such as a pile.

In the acrylic fiber of the second aspect of this invention, for a home furnishing material such as a pile and a boa, the long/short axis ratio in its cross section (flatness) is preferably 5 to 15 in the light of hand feeling and flexibility after being processed into a pile or boa. Flexibility is not adequate if the flatness is less than 5 after processed into a pile of boa, while the fiber tends to be split, causing, for example, irritation if it is more than 15.

There will be described an acrylic fiber according to the third aspect of this invention.

The acrylic fiber of this aspect comprises a plurality of flat arms radially extending from a monofilament center along a longitudinal direction. In other words, the cross section of the monofilament has a branched shape radially extending from the center such as an essentially Y-shape or cross shape. An angle formed by adjacent flat arms may be the same or different. For example, in an essentially Y-shape, three flat arms may be mutually extended at an angle of 120°. The cross section (the length in the axis direction and the width) of each flat arm constituting a monofilament may be mutually the same or different. Different cross sections may endow various additional hand feeling.

A monofilament comprising a plurality of flat arms radially extending from a monofilament center along a longitudinal direction may provide, after processing, a fluffy product with satisfactory softness and flexibility. In particular, the filament cross section is preferably an essentially Y-shape or cross shape with three or four flat arms for ensuring adequate flexibility in its root when its tip is split. Increase in the number of the arms may cause problems in manufacturing a spinneret and in manufacturing a fiber such as trapped water in the arm root adversely affecting drying and reduced spinnability. The monofilament most preferably has an essentially Y-shape consisting of three flat arms.

The acrylic fiber of the third aspect forms a crack with a length of 200 μm or more in the center of its tension rupture lateral surface along the filament axis direction when rupturing the monofilament in a tension test. Again, a status of the tension rupture lateral surface of a monofilament is observed for a rupture surface formed after rupturing the monofilament at a deformation rate of 100%/min under the conditions of 23° C. and 50% RH.

In this aspect, the feature of forming a long crack in the tension rupture lateral surface of the monofilament along the filament axis direction again indicates a structure in which orientation is even not only in its surface layer but also in its inside. However, the fiber of the third aspect has flat arms and tends to be split from its center. A crack with a length of at least 20 μm is, therefore, not adequate, but a crack of at least 200 μm from its center must be formed.

Such an acrylic fiber exhibits good softness because monofilament tips are split to an adequate length while it can retain adequate flexibility without split in a filament root. Excessively larger split may improve softness but reduce flexibility and does not give required hand feeling. Therefore, the crack length formed in the tension test is preferably less than 1000 μm.

The acrylic fiber of the third aspect preferably (c) consists of an acrylonitrile polymer comprising an acrylonitrile unit in at least 80 wt % and less than 95 wt %, (d) has a monofilament strength of 2.0 to 4.0 cN/dtex, and (e) has a monofilament elongation of 15 to 40%.

In the third aspect, if the monofilament dry strength of the dry acrylic fiber is less than 2.0 cN/dtex or its dry elongation is more than 40%, there may be generated many fluffs due to filament breaking during spinning, leading to a deteriorated process passage and significant deterioration in tip split property due to dry elongation of the fiber during polisher processing in boa or high pile formation.

If the monofilament dry strength is higher than 4.0 cN/dtex or the dry elongation is less than 15%, there may often be inadequate wool-like hand feeling required for an acrylic fiber for an application such as a garment, e.g., a sweater and a home furnishing, e.g., a pile.

In the acrylic fiber of the third aspect, a Young's modulus is preferably 5800 N/mm$^2$ or higher because a too low Young's modulus may give inadequate repulsion of a cloth after processing into a pile, leading to a poorly flexible product. In the light of hand feeling in the pile, the Young's modulus is more preferably 7000 to 12000 N/mm$^2$ for achieving both flexibility and softness.

Furthermore, in the acrylic fiber of the third aspect, a ratio of a/b is preferably 2.0 to 10.0, where "a" and "b" are the monofilament length from its center to the tip of the flat arm and the width of the flat arm, respectively. A too low ratio a/b may lead to inadequate flexibility while a too high ratio may cause excessive flexibility so that even split filament tips cannot provide adequate softness.

Next, there will be described a manufacturing process according to this invention.

A process for manufacturing an acrylic fiber comprises the steps of discharging a spinning feed solution comprising an acrylonitrile polymer comprising 80 wt % or more and less than 95 wt % of acrylonitrile unit in an organic solvent, into the first coagulation bath consisting of an aqueous organic solvent solution at 30 to 50° C. containing 20 to 70 wt % of an organic solvent which may be the same as or different from the organic solvent for the spinning feed solution, to form a coagulated filament; drawing the filament from the first coagulation bath at a rate of 0.3 to 2.0 times of the discharge linear velocity of the spinning feed solution; stretching the filament by 1.1 to 2.0 times in the second coagulation bath consisting of an aqueous organic solvent solution at 30 to 50° C. containing 20 to 70 wt % of an organic solvent which may be the same as or different from any of the two organic solvents; and subsequently conducting wet heat stretching of the filament by three times or more.

organic solvents which may be used in the manufacturing process of this invention can dissolve an acrylonitrile polymer; for example, dimethylacetamide, dimethylsulfoxide and dimethylformamide. Dimethylacetamide is particularly preferable because it is not affected by hydrolysis and exhibits good spinnability.

The conditions for the first coagulation bath, the conditions for the second coagulation bath and stretching in the second coagulation bath are important for improving orientation in an acrylic fiber produced.

It is preferable for even coagulation during forming a coagulated filament that both coagulation bathes have the essentially same organic solvent concentration. Specifically, a difference in an organic solvent concentration between these coagulation bathes is within 5 wt %, preferably within 3 wt %.

It is also preferable for even coagulation during forming a coagulated filament that both coagulation bathes are kept at the substantially same temperature. A temperature difference between the first and the second coagulation bathes is within 5° C., more preferably within 3° C.

It is also preferable that these bathes comprise the same organic solvent. It is particularly preferable that the spinning feed solution, the first coagulation bath and the second coagulation bath comprise the same organic solvent, for even coagulation during forming a coagulated filament, easy preparation of these coagulation bathes and easy recovery of the solvent.

Thus, most preferably, the spinning feed solution, the first coagulation bath and the second coagulation bath comprise dimethylacetamide as an organic solvent. It is particularly preferable to use dimethylacetamide as an organic solvent for these three solutions and to use an aqueous dimethylacetamide solution at the substantially same temperature and having the substantially same composition in the first and the second coagulation bathes.

In the process for manufacturing an acrylic fiber according to this invention, a coagulated filament drawn from the first coagulation bath is in a semi-coagulated state where only its surface is coagulated since the organic solvent concentration in the liquid contained in the coagulated filament is higher than that in the first coagulation bath. The filament can be, therefore, well stretched in the next step. The swollen coagulated filament containing the coagulation solution after drawing it from the first coagulation bath may be stretched in the air, but it is preferably stretched in the second coagulation bath for accelerating coagulation of the coagulated filament and easily controlling a temperature in the stretching step.

A draw ratio less than 1.1 in the second coagulation bath may fail to give an evenly oriented filament while a draw ratio higher than 2.0 tends to cause filament breaking, leading to reduced spinnability and deteriorated stretching properties during the subsequent wet heat stretching step.

In one embodiment of the manufacturing process of this invention, it is preferable that the concentration of the organic solvent in the first coagulation bath is 40 to 70 wt %; the drawing rate of a coagulated filament from the first coagulation bath is 0.3 to 0.6 times of the discharge linear velocity of the spinning feed solution; and the concentration of the organic solvent in the second coagulation bath is 40 to 70 wt %. Among these conditions, the drawing rate of a coagulated filament from the first coagulation bath is particularly characteristic. It may allow the thickness of the skin layer in the coagulated filament drawn from the first coagulation bath to be adjusted to 0.05 to 0.15 μm. The skin layer thinner than 0.05 μm in the coagulated filament drawn from the first coagulation bath tends to cause adhesion of filaments and irregular coagulation in the coagulation bath, leading to a fiber with poor cotton properties, while the skin layer thicker than 0.15 μm may inhibit coagulation of the coagulated filament and make the inside of the filament coarse, leading to a fiber whose surface is more oriented.

In the process of this invention, it is preferable that the first and the second coagulation bathes are at the same temperature and have the same composition, and that a coordinate (X,Y) is within the area delimited by the lines represented by the following equations (1) to (3):

$$Y=-X+105 \quad \text{(Eq.1)}$$

$$Y=-(1/2)X+77.5 \quad \text{(Eq.2)}$$

$$Y=-4X+315 \quad \text{(Eq.3)}$$

wherein Y is the coagulation-bath temperature (° C.) and X is the concentration of the organic solvent (wt %).

Figure 1:
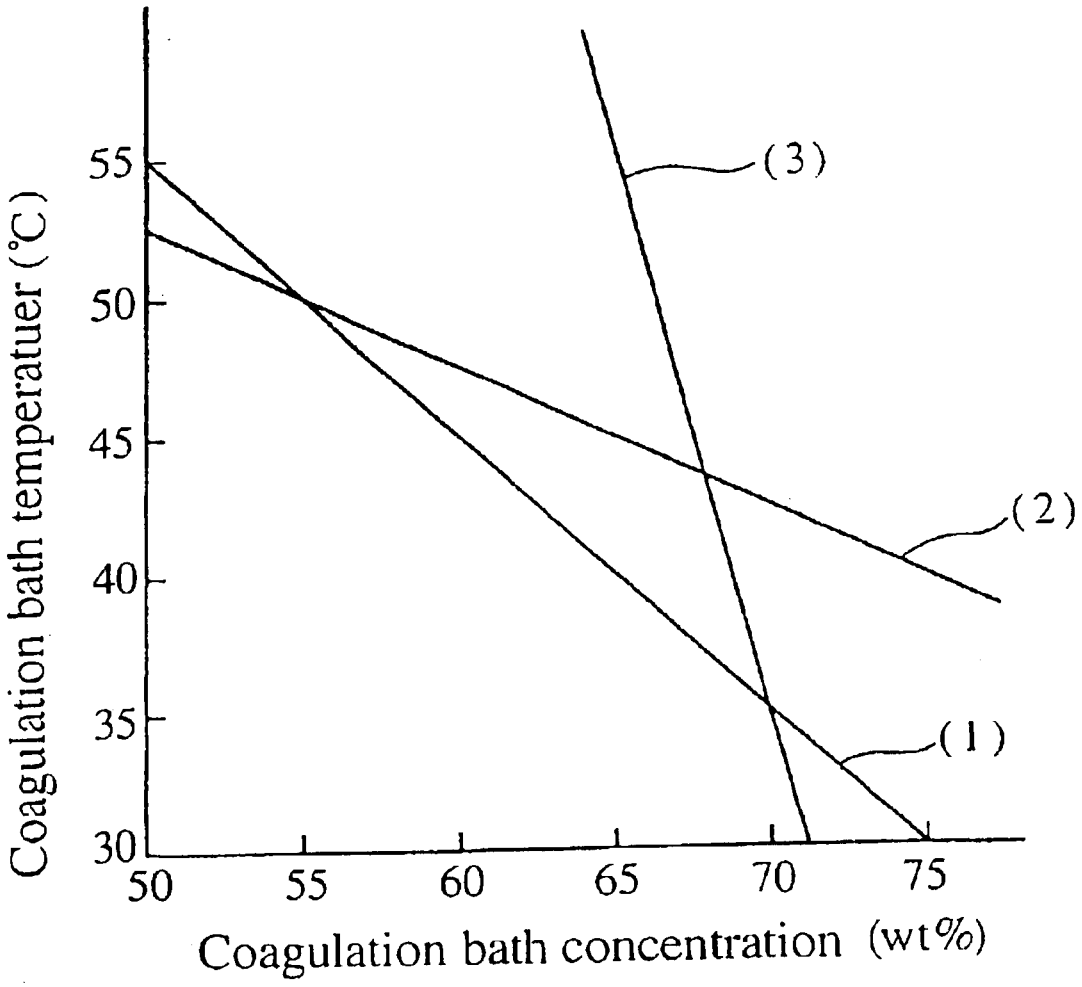
FIG. 1 is a graph on the xy plane illustrating the straight lines represented by the following equations.

The area delimited by these three lines is the triangle on the xy plane in FIG. 1. The coordinate (X,Y) within the triangle may allow a synthetic fiber with a perfect or substantially perfect circle cross section to be further exactly prepared, and therefore, make the process of this invention suitable to manufacturing an acrylic fiber for a cloth. It is particularly preferable that the drawing rate of a coagulated filament from the first coagulation bath is 0.3 to 0.6 times of the discharge linear velocity of the spinning feed solution.

In another aspect of the manufacturing process of this invention, it is preferable that the concentration of the organic solvent in the first coagulation bath is 20 to 60 wt %; the drawing rate of a coagulated filament from the first coagulation bath is 0.6 to 2.0 times of the discharge linear velocity of the spinning feed solution; and the concentration of the organic solvent in the second coagulation bath is 20 to 60 wt %. Among these conditions, the drawing rate of a coagulated filament from the first coagulation bath is again particularly characteristic. A higher drawing rate of a coagulated filament results in quick coagulation. Thus, the process is suitable to manufacturing a fiber with branched flat arms such as an essentially Y-shaped structure or a flat fiber which requires a sharp cross section.

For forming a fiber with flat arms radially branched from the center of a monofilament (typically, an essentially Y-shaped or cross-shaped structure), it is preferable that a spinneret capillary in a spinneret has such a shape. For example, it is preferable to use a spinneret with a spinneret capillary where a ratio A/B is 2.0 to 10.0 wherein "A" and "B" are the length of each radially branched opening arm from its center and the width of the branched opening arm, respectively.

When forming a flat fiber with a large ratio of long/short axes (flatness) in the fiber cross section, it is preferable to use a spinneret with a spinneret capillary in which a long/short axis ratio (flatness) is 5.0 to 15.0.

In the manufacturing processes of this invention, after stretching in the second coagulation bath, wet heat stretching of the filament by three times or more is conducted for further improving orientation in a fiber. Wet heat stretching may be conducted by stretching a swollen fiber just after stretching in the second coagulation bath while washing it with water, or by stretching it in hot water. For improving a productivity, stretching in hot water is preferable. More preferably, the fiber is stretched while washing with water, and subsequently stretched in hot water. If the stretching ratio in the wet heat stretching is less than 3, fiber orientation may be inadequately improved. The stretching ratio in the wet heat stretching may be appropriately selected as long as it is more than 3, but it is generally about 8 or less.

The fiber after stretching in the second coagulation bath may be dried before stretching. Stretching after drying may, however, often generate static electricity which considerably deteriorates convergency of the filaments. On the other hand, significant deterioration in convergency associated with stretching can be avoided according to the process of this invention where wet heat stretching is employed after stretching in the second coagulation bath.

In the process for manufacturing an acrylic fiber of this invention, it is preferable to adjust a degree of swelling of the swollen fiber after wet heat stretching and before drying to 70 wt % or less.

A swollen fiber after wet heat stretching and before drying whose degree of swelling is 70 wt % or less indicates that orientation is even in both its surface and inside. By reducing the ratio of (a drawing rate of a coagulated filament)/(a discharge linear velocity of a spinning feed solution from a spinneret capillary) during preparing a coagulated filament in the first coagulation bath, formed is the coagulated filament even in the first coagulation bath. Then the filament may be stretched in the second coagulation bath to prepare a fiber whose orientation is even to its inside. Thus, a degree of swelling of the swollen fiber after wet heat stretching and before drying can be adjust to 70 wt % or less.

In other words, when the ratio of (a drawing rate of a coagulated filament)/(a discharge linear velocity of a spinning feed solution from a spinneret capillary) is increased during preparing a coagulated filament in the first coagulation bath, coagulation of the coagulated filament occurs simultaneously with its stretching in the first coagulation bath, so that the coagulated filament is unevenly coagulated in the first coagulation bath. Therefore, even if the stretching in the second coagulation bath is performed, a degree of swelling of a swollen fiber after wet heat stretching and before drying is high. This means orientation of the resulting fiber is not even to its inside.

A degree of swelling of a swollen fiber before drying is calculated from the following equation:

$$\text{A degree of swelling } (\%) = (w - w_0) \times 100 / w_0$$

wherein "w" is a fiber weight after removing adhered liquid to the swollen fiber by centrifugation (3000 rpm, 15 min) and "$w_0$" is a fiber weight after drying the centrifuged fiber in a hot air dryer at 110° C. for 2 hours.

As described above, a fiber after stretching in the second coagulation bath and subsequent wet heat stretching is dried by a known process to prepare a desired acrylic fiber.

There will be specifically described an acrylic fiber according to this invention and a manufacturing process therefor with reference to Examples.

Tension Rupture Test

Using Tensilon UTM-II, a test monofilament with a length of 20 mm was ruptured with a deformation velocity of 100%/min under the conditions of 23° C. and 50% RH to prepare a test sample. The outer surface of the test sample was adhered to a sample plate for SEM and then the sample was subject to spattering with Au to about 10 nm. The sample was observed with an XL 20 scanning electron microscope (PHILIPS) under the conditions: an acceleration voltage of 7.00 kV and a working distance of 31 mm.

Determination of a Long/Short Axis Ratio of a Fiber Cross Section, a Length of a Flat Arm to its Tip "a" and its Width "b"

A long/short axis ratio of a fiber cross section was determined by inserting an acrylic fiber to be measured into a vinyl chloride resin tube with an inner diameter of 1 mm, cutting it into rings with a knife to prepare a test sample, adhering the test sample to a sample plate for SEM such that the cross section of the acrylic fiber faces upward, spattering the sample with Au to about 10 nm and then observing the sample with an XL 20 scanning electron microscope (PHILIPS) under the conditions: an acceleration voltage of 7.00 kV and a working distance of 31 mm. A length of a flat arm to its tip "a" and its width "b" are determined in the same manner.

Determination of an Average Tilt Angle and a Maximum Level Difference

A fiber is fixed on a slide glass using a double sided adhesive tape without tension, and observed by using a small-sized bench type of probe microscope Nanopics (Seiko Instruments Inc.). An average tilt angle and a maximum level difference are determined as follows. As shown in FIG. 4, the fiber surface is expressed as a wave form where selecting a line passing corrugation trough bottoms as a base line, an ordinate and an abscissa are a corrugation height and its length along the fiber periphery, respectively. Along the abscissa, perpendicular lines are drawn with a fine interval (0.015 μm interval), intersections of the perpendicular lines with the wave form are connected, and all of angles (a) less than 90° formed by the line and the perpendicular line are averaged to give an average tilt angle. A difference between the highest convex and the lowest concave (b) is a maximum level difference.

Measurement Conditions

Measurement mode: Damping mode

Observation range: 4 μm

Scanning rate: 90 sec/frame

Datum point number per an image: 512 pixel×256 lines

Determination of Luster in a Fiber Bundle by 45° Mirror Surface Luster Technique As shown in FIGS. 5(*a*) and 5(*b*), a fiber bundle (spinning tow) 3 with a total denier of 150 to 200 d was tightly wound on an acrylic resin plate 4 with a width of 50 mm and a thickness of 3 mm, without overlapping to prepare a sample with a width of 40 mm. Using VGS-300A (NIPPON DENSHOKU), an incident direction of light beam from a light source 1 was adjusted to vertical to the fiber axis of the sample. Furthermore, adjusting an incident angle of light beam from the light source 1 and a receiving angle at a receiver 2 to 45° to a perpendicular line, respectively, a luster was determined by a 45° mirror surface luster technique in accordance with JIS-Z-8741.

Determination of a Thickness of a Skin Layer in a Coagulated Filament

A coagulated filament drawn from the first coagulation bath was soaked in an aqueous organic solvent solution having the same composition as the first coagulation bath. Then, the filament was sequentially soaked at room temperature in mixtures of an aqueous organic solvent solution/ethanol with the ratio of "the aqueous organic solvent solution/ethanol" being gradually changed. The solution was finally replaced with ethanol. The filament was sequentially soaked in mixture of ethanol/Spurr Resin (an epoxy resin for embedding a electron microscopy sample) with gradually changing the ratio, and Spurr Resin (i.e., replacement with Spurr Resin). Then, the filament was left overnight to be subject to polymerization embedding to prepare a sample. The sample was cut into rings with a microtome, one of which was then observed with a transmission electron microscope at an acceleration voltage of 40 kV to determine the thickness of the skin layer in the coagulated filament.

EXAMPLE 1

A monomer composition consisting of 92 wt % of acrylonitrile and 8 wt % of vinyl acetate was polymerized by aqueous dispersion polymerization using ammonium persulfate-sodium hydrogen sulfite to prepare an acrylonitrile polymer with an average molecular weight of 130,000. The polymer was dissolved in dimethylacetamide to prepare a 24 wt % spinning feed solution.

The spinning feed solution was discharged into the first coagulation bath consisting of a 50 wt % aqueous dimethylacetamide solution at 40° C. using a spinneret with 40,000 orifice holes and an orifice hole diameter of 60 μm to prepare coagulated filaments. The filaments were drawn from the first coagulation bath with a drawing rate 0.4 times of the discharge linear velocity of the spinning feed solution. Then, the coagulated filaments were immersed into the second coagulation bath consisting of a 50 wt % aqueous dimethylacetamide solution at 40° and was subject to stretching by 1.5 times in the bath. While washing with water, the filaments were further stretched by 2.7 times and in hot water by 1.9 times. Then, the filaments were oiled, dried on a hot roll at 150° C., crimped, heated and cut to provide a staple fiber with a monofilament denier of 3.3 dtex.

In the above process, a monofilament cross section of the coagulated filaments drawn from the first coagulation bath was observed with a transmission electron microscope. The thickness of the skin layer was 0.1 μm. The monofilament exhibited a dry strength of 3.2 cN/dtex, a dry elongation of 45%, and the staple fiber exhibited good luster and hand feeling.

The observation using scanning electron microscopy was conducted for a monofilament cross section and a tension rupture lateral surface of a monofilament. The filament cross section was an ellipse with a long/short axis ratio of 1.8. Four cracks with lengths of 25 μm, 20 μm, 20 μm and 18 μm along the fiber axis direction were observed in the tension rupture lateral surface.

EXAMPLE 2

A staple fiber with a monofilament denier of 3.3 dtex was prepared as described in Example 1, except that the temperatures of the first and the second coagulation bathes were 46° C. and the concentration of the organic solvent was 60 wt %.

In the above process, the thickness of the skin layer in a coagulated filament drawn from the first coagulation bath was 0.08 μm. The monofilament exhibited a dry strength of 3.5 cN/dtex, a dry elongation of 37%, and the staple fiber exhibited good luster and hand feeling.

The filament cross section was an essentially perfect circle with a long/short axis ratio of 1.1. Five cracks with lengths of 25 μm, 24 μm, 20 μm, 18 μm and 15 μm along the fiber axis direction were observed in the tension rupture lateral surface.

EXAMPLE 3

The spinning feed solution described in Example 1 was discharged into the first coagulation bath consisting of a 67 wt % aqueous dimethylacetamide solution at 40° C. using a spinneret with 40,000 orifice holes and an orifice hole diameter of 60 μm to prepare coagulated filaments. The filaments were drawn from the first coagulation bath with a drawing rate 0.3 times of the discharge linear velocity of the spinning feed solution. Then, the coagulated filaments were immersed into the second coagulation bath consisting of a 67 wt % aqueous dimethylacetamide solution at 40° and was subject to stretching by 1.5 times in the bath. While washing with water, the filaments were further stretched by 2.7 times and in hot water by 1.9 times. Then, the filaments were oiled, dried on a hot roll at 150° C., crimped, heated and cut to provide a staple fiber with a monofilament thickness of 2.2 dtex.

In the above process, the thickness of the skin layer in a coagulated filament drawn from the first coagulation bath was 0.07 μm. The monofilament exhibited a dry strength of 3.4 cN/dtex, a dry elongation of 40%, and the staple fiber exhibited good luster and hand feeling.

The filament cross section was an essentially perfect circle with a long/short axis ratio of 1.05. Six cracks with lengths of 30 μm, 26 μm, 22 μm, 21 μm, 18 μm and 15 μm along the fiber axis direction were observed in the tension rupture lateral surface.

EXAMPLE 4

A staple fiber with a monofilament denier of 2.2 dtex was prepared as described in Example 3, except that the temperatures of the first and the second coagulation bathes were 46° C. and the concentration of the organic solvent was 60 wt %.

In the above process, the thickness of the skin layer in a coagulated filament drawn from the first coagulation bath was 0.09 μm. The monofilament exhibited a dry strength of 2.9 cN/dtex, a dry elongation of 37%, and the staple fiber exhibited good luster and hand feeling.

The filament cross section was an essentially perfect circle with a long/short axis ratio of 1.1. Three cracks with lengths of 26 μm, 24 μm and 21 μm along the fiber axis direction were observed in the tension rupture lateral surface.

EXAMPLE 5

A staple fiber with a monofilament denier of 2.2 dtex was prepared as described in Example 3, except that the temperatures of the first and the second coagulation bathes were 45° C. and the concentration of the organic solvent was 58 wt %.

In the above process, the thickness of the skin layer in a coagulated filament drawn from the first coagulation bath was 0.1 μm. The monofilament exhibited a dry strength of 2.8 cN/dtex, a dry elongation of 37%, and the staple fiber exhibited good luster and hand feeling.

The filament cross section was an essentially perfect circle with a long/short axis ratio of 1.2. Two cracks with lengths of 25 μm and 20 μm along the fiber axis direction were observed in the tension rupture lateral surface.

EXAMPLE 6

A staple fiber with a monofilament denier of 2.2 dtex was prepared as described in Example 3, except that the temperatures of the first and the second coagulation bathes were 38° C. and the concentration of the organic solvent was 65 wt %.

In the above process, the thickness of the skin layer in a coagulated filament drawn from the first coagulation bath was 0.06 μm. The monofilament exhibited a dry strength of 3.3 cN/dtex, a dry elongation of 39%, and the staple fiber exhibited good luster and hand feeling.

The filament cross section was an essentially perfect circle with a long/short axis ratio of 1.15. Five cracks with lengths of 31 μm, 27 μm, 23 μm, 20 μm and 18 μm along the fiber axis direction were observed in the tension rupture lateral surface.

EXAMPLE 7

A monomer composition consisting of 92 wt % of acrylonitrile and 8 wt % of vinyl acetate was polymerized by aqueous dispersion polymerization using ammonium persulfate-sodium hydrogen sulfite to prepare a polymer with an average molecular weight of 130,000. The polymer was dissolved in dimethylacetamide to prepare a 24 wt % spinning feed solution.

The spinning feed solution was discharged into the first coagulation bath consisting of a 30 wt % aqueous dimethylacetamide solution at 40° C. using a spinneret with 10,000 orifice holes and an orifice hole size of 0.035 mm×0.3 mm under the condition of a ratio of "a drawing rate of a coagulated filament/a discharge linear velocity of a spinning feed solution from a spinneret capillary" of 0.73 and were drawn at the drawing rate of a coagulated filament of 5.0 m/min to prepare coagulated filaments. Then, the coagulated filaments were immersed into the second coagulation bath having the same composition at the same temperature as the first coagulation bath and was subject to stretching by 1.6 times in the bath. While washing with water, the filaments were further stretched by 3.0 times and in hot water by 1.67 times. Then, the filaments were oiled, dried on a hot roll at 150° C., crimped, heated and cut to provide a staple fiber with a monofilament denier of 5.5 dtex. The results are shown in Table 1.

EXAMPLE 8

An acrylic fiber was prepared as described in Example 7, except that coagulated filaments were discharged into the first coagulation bath under the condition of a ratio of "a drawing rate of a coagulated filament/a discharge linear velocity of a spinning feed solution from a spinneret capillary" of 0.98 and were drawn at the drawing rate of a coagulated filament of 6.0 m/min to prepare coagulated filaments, and were then stretched by 1.2 times in the second coagulation bath having the same composition at the same temperature as the first coagulation bath. The results are shown in Table 1.

EXAMPLE 9

A monomer composition consisting of 92 wt % of acrylonitrile and 8 wt % of vinyl acetate was polymerized by aqueous suspension polymerization using ammonium persulfate-sodium hydrogen sulfite to prepare an acrylonitrile polymer with an average molecular weight of 130,000. The polymer was dissolved in dimethylacetamide to prepare a 24 wt % spinning feed solution.

The spinning feed solution was discharged into the first coagulation bath from a spinneret with 6000 orifice holes. In the spinneret, a orifice hole 10 had an essentially Y-shape in which three branched openings 11 were radially extended from the center as shown in FIG. 6 and a ratio A/B was 120 μm/40 μm (=3.0) wherein "A" and "B" are the length of each branched opening arm 11 from its center and the width of the branched opening, respectively. The first coagulation bath consisted of a 30 wt % aqueous dimethylacetamide solution at 40° C., and the coagulated filaments were drawn from the first coagulation bath with a drawing rate 1.6 times of the discharge linear velocity of the spinning feed solution.

Then, the coagulated filaments were immersed into the second coagulation bath consisting of a 30 wt % aqueous dimethylacetamide solution at 40° C. and was subject to stretching by 1.5 times in the bath. While washing with water, the filaments were further stretched by 2.7 times and in hot water by 1.9 times. Then, the filaments were oiled and dried on a hot roll at 150° C. The acrylic fiber thus obtained was crimped, heated and cut to provide a staple fiber with a Y-shaped cross section and with a monofilament thickness of 6.6 dtex.

A monofilament exhibited a Young's modulus of 6370 $N/mm^2$, and the staple fiber exhibited good luster and hand feeling.

A monofilament cross section was observed to determine a length from the filament center to a flat arm tip "a" and the width of the arm "b". The ratio of (length a)/(width b) was 5.0.

The acrylic fiber was subject to tension rupture and the rupture lateral surface was observed. In the rupture lateral surface, a crack with a length of 200 μm extending along a fiber axis direction was observed in the center of the fiber.

In the acrylic fiber in this example, the above crack had a length of 200 μm and orientation was adequate in its surface as well as its inside. The acrylic fiber was processed into a pile exhibiting good hand feeling with both softness and adequate flexibility because tips of filaments were fully split while their roots were not split.

EXAMPLE 10

A staple fiber with a Y-shaped cross section was prepared as described in Example 9, except that an stretching ratio was 1.8 in the second coagulation bath. A monofilament obtained had a Young's modulus of 6900 $N/mm^2$ and exhibited good luster and hand feeling.

A monofilament cross section and a monofilament tension rupture lateral surface were observed as described in Example 9. A ratio of a/b was 4.0 where "a" and "b" are a length from the filament center to a flat arm tip and the width of the arm, respectively. In the tension rupture lateral surface, a crack with a length of 250 μm extending along a fiber axis direction was observed in the center of the fiber.

The acrylic fiber of this example was processed into a pile exhibiting softness and adequate flexibility because tips of filaments were fully split while their roots were not split as was in Example 9.

Comparative Example 1

The spinning feed solution described in Example 1 was discharged into the first coagulation bath consisting of a 50 wt % aqueous dimethylacetamide solution at 40° C. using a spinneret with 40,000 orifice holes and an orifice hole diameter of 60 μm to prepare coagulated filaments. The filaments were drawn from the first coagulation bath with a drawing rate 1.0 time of the discharge linear velocity of the spinning feed solution. Then, while washing with water, the filaments were stretched by 2.7 times and in hot water by 1.9 times. Then, the filaments were oiled, dried on a hot roll at 150° C., crimped, heated and cut to provide a staple fiber with a monofilament denier of 3.3 dtex.

In the above process, the thickness of the skin layer in a coagulated filament drawn from the first coagulation bath was 0.4 μm. The monofilament exhibited a dry strength of 2.4 cN/dtex, a dry elongation of 45%. However, luster and hand feel of the staple fiber was poor.

The fiber cross section was substantially an ellipse with a long/short axis ratio of 1.8. In the tension rupture lateral surface, there were observed no cracks 20 μm or longer extending along a fiber axis.

Comparative Example 2

A staple fiber with a thickness of 3.3 dtex was prepared as described in Comparative Example 1, except that dry heat stretching by 1.2 times was conducted after hot water stretching.

In the above process, the thickness of the skin layer in a coagulated filament drawn from the first coagulation bath was 0.4 μm. The monofilament exhibited a dry strength of 3.2 cN/dtex and a dry elongation of 30%.

The fiber cross section was a broad-bean shape with a long/short axis ratio of 1.8. In the tension rupture lateral surface, there were observed no cracks 20 μm or longer extending along a fiber axis.

Comparative Example 3

Preparation of a staple fiber was attempted as described in Example 3, except that filaments were drawn from the first coagulation bath with a drawing rate 1.2 time of the discharge linear velocity of the spinning feed solution, but spinning was unstable due to considerable filament breaking in the first coagulation bath.

Comparative Example 4

The spinning feed solution described in Example 1 was discharged into the first coagulation bath consisting of a 67 wt % aqueous dimethylacetamide solution at 40° C. through a spinneret with 40,000 orifice holes and an orifice hole diameter of 60 μm to prepare coagulated filaments. The filaments were drawn from the first coagulation bath with a drawing rate 0.8 time of the discharge linear velocity of the spinning feed solution. Then, they were subject to dry heat stretching in the air, but the stretching was quite unstable due to considerable filament breaking.

Comparative Example 5

The spinning feed solution described in Example 1 was discharged into the first coagulation bath consisting of a 50 wt % aqueous dimethylacetamide solution at 40° C. using a spinneret with 40,000 orifice holes and an orifice hole diameter of 60 μm to prepare coagulated filaments. The filaments were drawn from the first coagulation bath with a drawing rate 0.9 time of the discharge linear velocity of the spinning feed solution. Then, the coagulated filaments were immersed into the second coagulation bath consisting of a 50 wt % aqueous dimethylacetamide solution at 40° C. and was subject to stretching by 1.05 times in the bath. While washing with water, the filaments were stretched by 2.7 times and in hot water by 1.9 times. Then, the filaments were oiled, dried on a hot roll at 150° C., crimped, heated and cut to provide a staple fiber with a monofilament denier of 3.3 dtex.

In the above process, the thickness of the skin layer in a coagulated filament drawn from the first coagulation bath was 0.3 μm. The monofilament exhibited a dry strength of 2.5 cN/dtex and a dry elongation of 45%.

The fiber cross section was substantially a broad-bean shape with a long/short axis ratio of 1.8. In the tension rupture lateral surface, there were observed no cracks 20 μm or longer extending along a fiber axis.

The staple fiber exhibited inadequate elasticity, and gave a cloth with poor repulsion which did not have hand feeling required for a garment such as a sweater or a home furnishing material such as a pile.

Comparative Example 6

An acrylic fiber was prepared as described in Example 7, except that coagulated filaments were drawn at 8.0 m/min under the condition of a ratio of "a drawing rate of a coagulated filament in the first coagulation bath/a discharge linear velocity of a spinning feed solution from a spinneret capillary" of 1.18, the second coagulation bath was not used, and while washing with water, the filaments were stretched by 3.0 times and 1.64 times in hot water. The results are shown in Table 1.

Comparative Example 7

An acrylic fiber was prepared as described in Example 7, except that coagulated filaments were drawn at 10.0 m/min under the condition of a ratio of "a drawing rate of a coagulated filament in the first coagulation bath/a discharge linear velocity of a spinning feed solution from a spinneret capillary" of 1.47, the second coagulation bath was not used, and while washing with water, the filaments were stretched by 3.0 times and 1.33 times in hot water. The results are shown in Table 1.

Comparative Example 8

An acrylic fiber was prepared as described in Comparative Example 6, except that $TiO_2$ was added to the spinning feed solution to 0.5% based on the polymer. The results are shown in Table 1.

Comparative Example 9

An acrylic fiber was prepared as described in Example 7, except that coagulated filaments were drawn at 4.0 m/min under the condition of a ratio of "a drawing rate of a coagulated filament in the first coagulation bath/a discharge linear velocity of a spinning feed solution from a spinneret capillary" of 0.59 and then the filaments were stretched by 2.0 times in the second coagulation bath at the same temperature with the same concentration as the first coagulation bath. The results are shown in Table 1.

Comparative Example 10

An acrylic fiber was prepared as described in Example 7, except that coagulated filaments were drawn at 11.4 m/min under the condition of a ratio of "a drawing rate of a coagulated filament in the first coagulation bath/a discharge linear velocity of a spinning feed solution from a spinneret capillary" of 1.68, the filaments were stretched by 1.5 times in the second coagulation bath at the same temperature with the same concentration as the first coagulation bath, and while washing with water, the filaments were stretched by 2.0 times and 1.16 times in hot water. The results are shown in Table 1.

Comparative Example 11

The spinning feed solution in Example 9 was discharged in the first coagulation bath in Example 9 using the spinneret in Example 9. The coagulated filaments were drawn with a drawing rate 1.6 times of the discharge linear velocity of the spinning feed solution and without conducting stretching in the second coagulation bath, while washing with water, the filaments were stretched by 2.7 times and in hot water by 1.9 times. As described in Example 9, the filaments were oiled and dried on a hot roll at 150° C. The acrylic fiber thus obtained was crimped, heated and cut to provide a staple fiber with a Y-shaped cross section and with a monofilament denier of 6.6 dtex.

A monofilament obtained exhibited a Young's modulus as low as 5400 N/mm$^2$, and had poor repulsion.

A monofilament cross section and a monofilament tension rupture lateral surface were observed as described in Example 9. A ratio of a/b was 6.0 where "a" and "b" were a length from the filament center to a flat arm tip and the width of the arm, respectively. In the tension rupture lateral surface, there was observed a crack extending along the fiber axis in the center, but it was as short as 150 $\mu$m.

The acrylic fiber was processed into a pile, in which filament tips were not adequately split and which was not soft because the above crack length 150 $\mu$m was too short to give a fiber not fully oriented to its inside. Furthermore, due to a Young's modulus as low as 5400 N/mm$^2$, the pile exhibited inadequate repulsion and poor flexibility.

TABLE 1

| | R* | Total draw ratio | Maximum level difference ($\mu$m) | Average tilt angle (°) | Fiber bundle surface lusteriness | Brushing effect | Color-developing property |
|---|---|---|---|---|---|---|---|
| Ex. 7 | 0.73 | 8.0 | 0.3 | 19 | 14.0 | ○ | ○ |
| Ex. 8 | 0.98 | 6.0 | 0.2 | 16 | 16.0 | ○ | ○ |
| Comp Ex. 6 | 1.18 | 5.0 | 0.12 | 14 | 23.0 | X | ○ |
| Comp Ex. 7 | 1.47 | 4.0 | 0.08 | 12 | 26.0 | X | ○ |
| Comp Ex. 8 | 1.18 | 5.0 | 0.2 | 15 | 9.0 | ○ | X |
| Comp Ex. 9 | 0.59 | 9.0 | 0.4 | 20 | 12.0 | X | ○ |
| Comp Ex. 10 | 1.68 | 3.5 | 0.3 | 30 | 20.0 | X | ○ |

*Ratio of drawing rate/discharge linear velocity of a spinning feed solution from a nozzle
○: satisfactory
X: Poor Next, some of acrylic fibers obtained above examples and comparative examples were observed by scanning electron microscope (SEM). The images of SEM are shown in FIGS. 8 to 15.

Oblique view of the fiber obtained in example 1 is shown in FIG. 8(*a*). A lateral surface of the fiber ruptured in the tension test is shown FIG. 8(*b*). Cracks with lengths of 20 $\mu$m or longer along the fiber axis direction were observed in the tension rupture lateral surface.

Oblique view of the fiber obtained in comparative example 1 is shown in FIG. 9(*a*). A lateral surface of the fiber ruptured in the tension test is shown FIG. 9(*b*). It is found only short cracks along the fiber axis direction were observed in the tension rupture lateral surface.

Oblique view of the fiber obtained in example 3 is shown in FIG. 10. As shown in this figure, the fibers with round shape in the filament cross section were obtained.

Oblique view of the fiber obtained in comparative example 5 is shown in FIG. 11. As shown in this figure, the fibers obtained in this comparative example have the cross section with a broad-bean shape in comparison with that obtained example 3.

Oblique view of the fiber obtained in example 7 is shown in FIG. 12(*a*). It is found that the flat shaped fibers were obtained in this example. As shown FIG. 12(*b*), on the surface of the fiber, corrugations with large level difference were observed.

Oblique view of the fiber obtained in comparative example 6 is shown in FIG. 13(*a*). It is found that the flat fibers were obtained in this comparative example as in example 7. As shown FIG. 13(*b*), unlike example 7, the level difference of corrugations on the surface of the fiber is short and the surface were smooth.

Oblique view of the fiber obtained in example 9 is shown in FIG. 14(*a*). It is found that the fibers with Y shape cross section were obtained in this example. Cracks with lengths of 200 $\mu$m or longer along the fiber axis direction were observed in the tension rupture lateral surface as shown FIG. 14(*b*).

Oblique view of the fiber obtained in comparative example 11 is shown in FIG. 15(*a*). It is found that the fibers with Y shape cross section were obtained in this example as in example 9. As shown FIG. 15(*b*), unlike example 9, it is found that only short cracks along the fiber axis direction were observed in the tension rupture lateral surface.

INDUSTRIAL APPLICABILITY

In conclusion, an acrylic fiber according to this invention has even orientation in its surface and inside; is significantly improved in dry strength, dry elongation and dyeability; exhibits wool-like hand feeling; and is therefore quite suitable as a synthetic fiber for various applications such as a garment material, e.g., a sweater and a home furnishing material such as a pile.

According to a process for manufacturing an acrylic fiber of this invention, the thickness of a skin layer in a coagulated filament is controlled to give a filament evenly coagulated to its inside. Specifically, inadequate diffusion of a solvent in the filament inside is avoided to prevent the solvent from being rapidly diffused during washing to make orientation even in the surface and the inside. Thus, an acrylic fiber significantly improved in dry strength, dry elongation and dyeability can be readily and exactly manufactured.

What is claimed is:

1. An acrylic fiber comprising:

a plurality of flat arms radially extending from a center along a longitudinal direction; and a crack with a length of 200 $\mu$m or more in the center of its tension rupture lateral surface along the filament axis direction when rupturing the monofilament in a tension test.

2. The acrylic fiber as claimed in claim 1, wherein said acrylic fiber consist; of an acrylonitrile polymer comprising an acrylonitrile unit in at least 80 wt % and less than 95 wt %; and wherein said fiber comprises a monofilament dry strength of 2.0 to 4.0 N/dtex; and a monofilament dry elongation of 15 to 40%.

3. The acrylic fiber as claimed in claim 1, wherein said acrylic fiber has a Young's modulus is 5800 N/mm$^2$ or higher.

4. The acrylic fiber as claimed in claim 2, wherein said acrylic fiber has a Young's modulus is 5800 N/mm$^2$ or higher.

5. The acrylic fiber as claimed in claim 1, wherein a ratio of a/b is 2.0 to 10.0, wherein "a" and "b" are the monofilament length from its center to the tip of the flat arm and the width of the flat arm, respectively.

6. The acrylic fiber as claimed in claim 2, wherein a ratio of a/b is 2.0 to 10.0, wherein "a" and "b" are the monofilament length from its center to the tip of the flat arm and the width of the flat arm, respectively.

* * * * *